US005111626A

United States Patent [19]

Fortune

[11] Patent Number: 5,111,626

[45] Date of Patent: May 12, 1992

[54] SELF-CONTAINED MODULAR UNIT

[76] Inventor: Jeffrey L. Fortune, 502 Sandy Hook Dr., Treasure Island, Fla. 33706

[21] Appl. No.: 601,285

[22] Filed: Oct. 22, 1990

[51] Int. Cl.[5] ..... E04H 1/00

[52] U.S. Cl. ..... 52/79.1; 52/220; 52/173 R; 52/143

[58] Field of Search ..... 52/143, 220, 308.7, 52/79.1, 79.6, 36, 173, 90; 70/278; 4/663, 664, 599, 600; 296/168; 340/604; 74/529; 126/171.1

[56] References Cited

U.S. PATENT DOCUMENTS

| | | | |
|---|---|---|---|
| 2,296,413 | 9/1942 | Zell | 52/36 |
| 2,485,914 | 10/1949 | Owens | 52/36 |
| 2,561,265 | 7/1951 | Burns | 4/599 |
| 2,817,091 | 12/1957 | Painter | 4/664 |
| 2,840,101 | 6/1958 | Saylor | 296/168 |
| 2,907,048 | 10/1959 | Gould | 4/663 |
| 3,108,820 | 10/1963 | Rich | 296/168 |
| 3,462,897 | 8/1969 | Weinrott | 52/90 |
| 3,594,825 | 7/1971 | Reid | 4/663 |
| 3,646,590 | 2/1972 | Bolt | 4/600 |
| 3,778,528 | 12/1973 | Heifetz et al. | 52/308.7 |
| 3,838,545 | 10/1974 | Kump | 52/220 |
| 4,083,424 | 7/1978 | Stemmen et al. | 70/278 |
| 4,112,524 | 9/1978 | Johansson | 5/664 |
| 4,191,348 | 3/1980 | Holwerda | 126/171.1 |
| 4,280,595 | 7/1981 | Timms et al. | 74/529 |
| 4,346,002 | 8/1982 | Petzinger | 4/DIG. 12 |
| 4,788,802 | 12/1988 | Wokas | 52/79.1 |
| 4,796,658 | 10/1989 | Capie | 340/604 |
| 4,845,472 | 7/1989 | Gordon et al. | 340/604 |
| 4,901,545 | 2/1990 | Bacon et al. | 70/278 |

*Primary Examiner*—James L. Ridgill, Jr.
*Attorney, Agent, or Firm*—Jordan M. Meschkow; Don J. Flickinger; Lowell W. Gresham

[57] ABSTRACT

A modular unit having a double shelled module housing closed by a door secured by a locking system and being substantially portable and self-contained requiring only an AC plug and telephone and television lines. A service unit supplies all water and collects all waste from the modular unit which contains a shower, toilet, lavatory and sleeping facilities.

19 Claims, 7 Drawing Sheets

FIG. 1
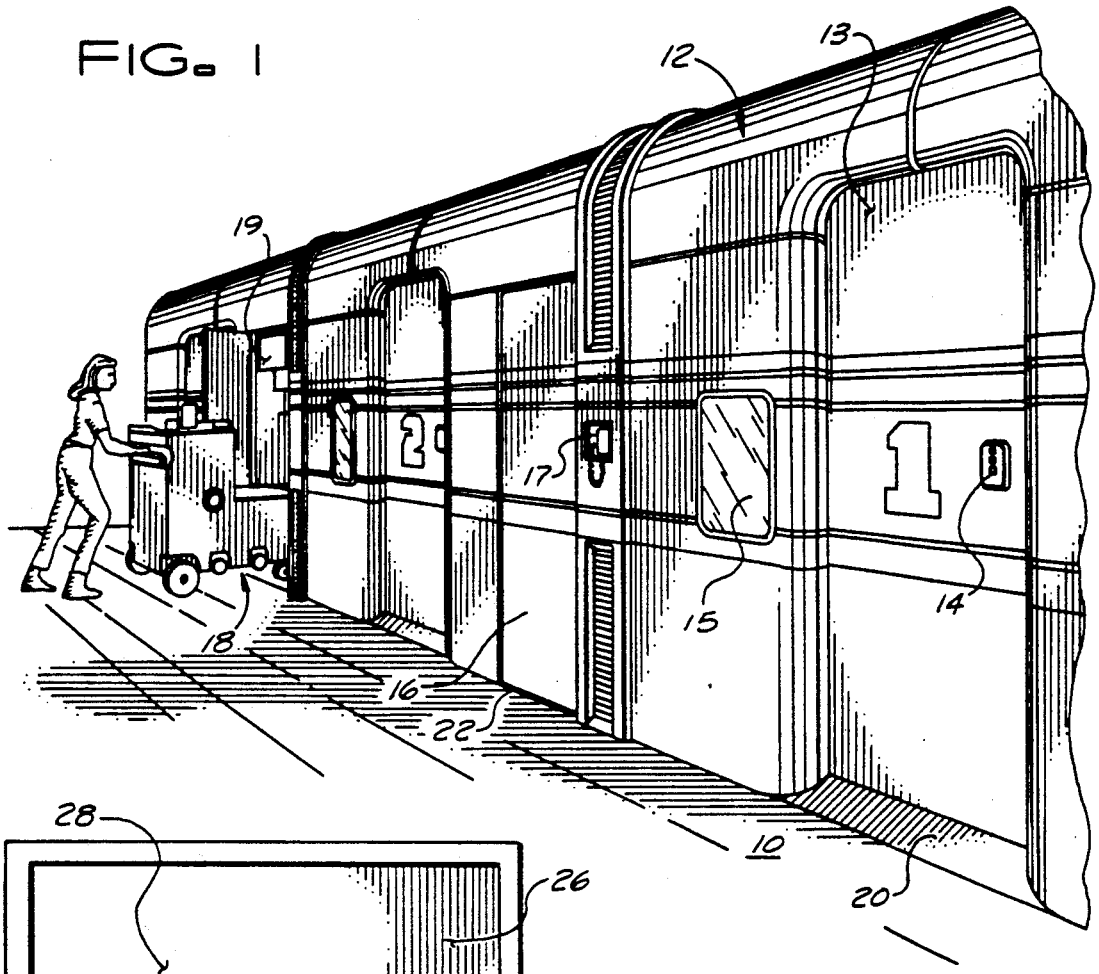
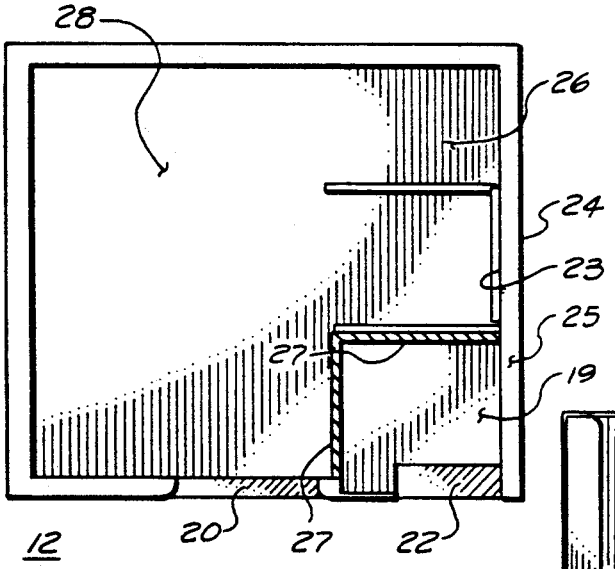
FIG. 2
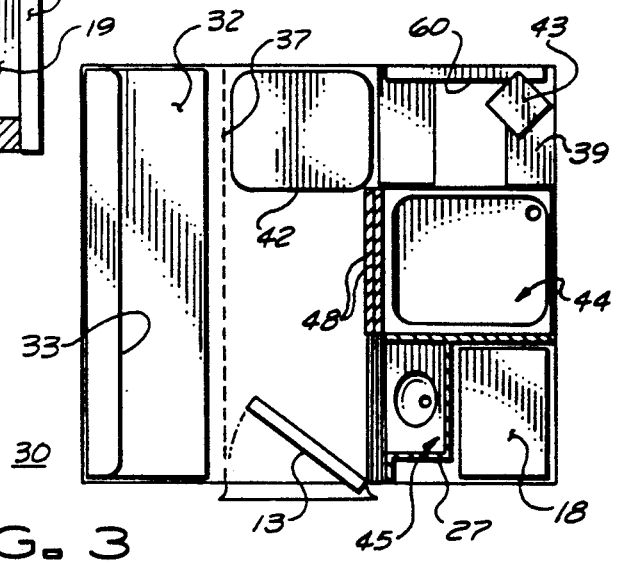
FIG. 3

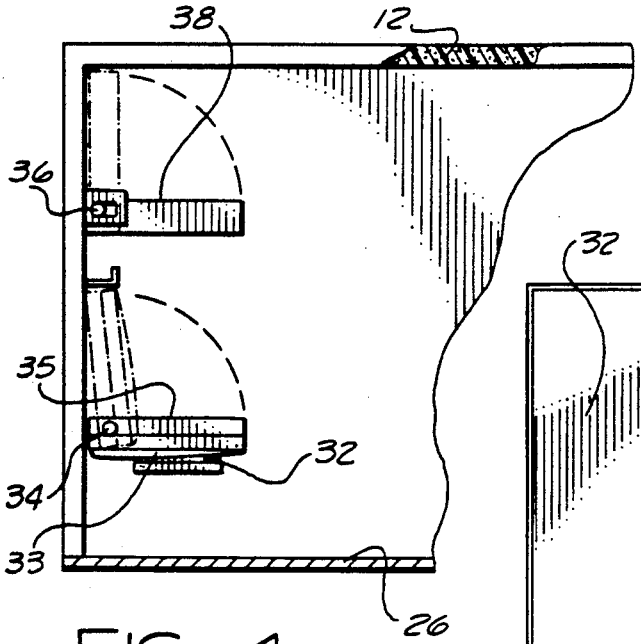
FIG. 4
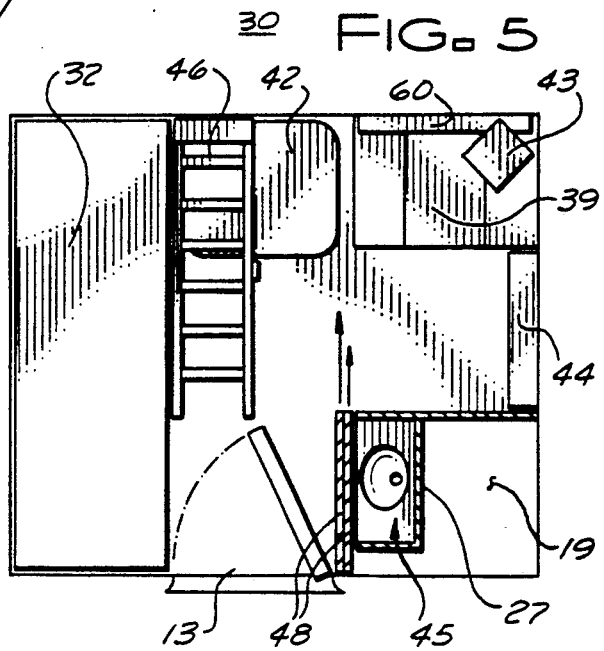
FIG. 5
FIG. 6
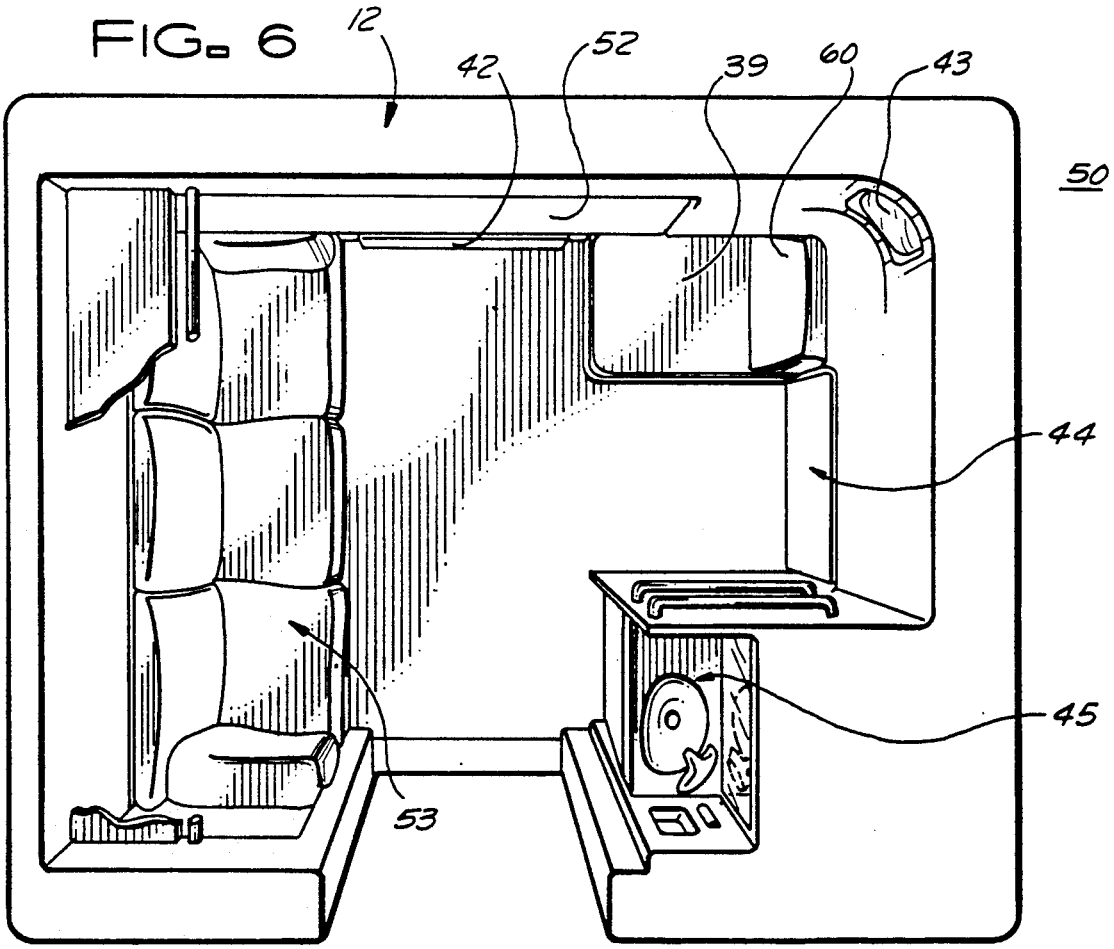

SELF-CONTAINED MODULAR UNIT

BACKGROUND OF THE INVENTION

1. Field of the Invention

This invention relates to a rest facility utilizing space saving designs.

More particularly this invention relates to a modular self-contained private space which may be used for a variety of purposes.

2. Prior Art

Travelers are spending more and more time in transportation terminals which are often crowded and not necessarily pleasant places to wait. Many times a traveler will also require a private space for different purposes such as cleaning-up or resting. There are only limited alternatives available to these travelers. They may wait for short times in lounges, waiting areas or nearby restaurants. However, if longer periods of time or needs other than just waiting are required, than these are insufficient. A restroom may be used to freshen-up, and possibly even change cloths, but a quick unsatisfactory cleaning is all that can be achieved. The best alternative is to check-in to a hotel. There the traveler can take a shower, change cloths and rest in comfort and privacy. However, a hotel may not be conveniently located near the transportation terminal, in which case time and money will be spent in more traveling to the hotel. Also, arrival may be at any time of the day or night. Travelers occasionally arrive at connecting terminals or their destination at hours that do not permit hotel check-in. Hotels typically require a 24 hours room rental. When only a few hours are needed for rest or cleaning up, paying for the extra time is a waste of time and money.

It would be highly advantages therefore to remedy the foregoing and other deficiencies inherent in the prior art.

Accordingly it is an object of the present invention to provide a new and improved modular self-contained private space.

Another object of the present invention is to provide a convenient private area.

And another object of the invention is to provide a secure area where a traveler may rest, bathe, change cloths or a number of other activities which require privacy.

Still another object of the present invention is to provide a private area which may be utilized for short periods of time.

Yet another object of the present invention is to provide a modular unit which is self-contained and may be used relatively anywhere.

Yet still another object of the present invention is to provide a modular unit with a contained water and waste unit which may be quickly and easily replaced.

SUMMARY OF THE INVENTION

Briefly, to achieve the desired objects of the present invention in accordance with the preferred embodiment thereof, provided is a modular unit having an inner and an outer shell. All electrical, plumbing, television, telephone and other services are routed through the space between the inner and outer shells. The remaining space between shells is filled by a structural foam. The module unit has a door for entry, secured by a locking system which is accessed by an entry code. The entry code can be changed after each use.

The modular unit is self-contained except for a connection to an AC outlet and any television or telephone lines desired. The modular unit contains sleeping facilities, lavatory, shower and concealed toilet. The customer is able to partition off the lavatory, shower or toilet areas using sliding partitions. A service unit is coupled to the modular unit and supplies all water needed and collects waste. A control logic system controls a fluid system of which the service unit is part.

BRIEF DESCRIPTION OF THE DRAWINGS

The foregoing and further and more specific objects and advantages of the instant invention will become readily apparent to those skilled in the art from the following detailed descriptions of the preferred embodiments thereof taken in conjunction with the drawings in which:

FIG. 1 is a perspective view illustrating modular units in transportation terminal;

FIG. 2 is a cross-sectional top view of the module having interior of the present invention;

FIG. 3 is a top view of a first embodiment of a modular interior of the present invention;

FIG. 4 is a side view of the sleeping arrangements of the first embodiment illustrating stored and extended positions;

FIG. 5 is a top view of the first embodiment of the present invention similar to FIG. 3, illustrating deployment of a ladder giving access to the top berth;

FIG. 6 is a top view perspective view of a second embodiment of the present invention;

DETAILED DESCRIPTION OF THE PREFERRED EMBODIMENT

Figure 7:
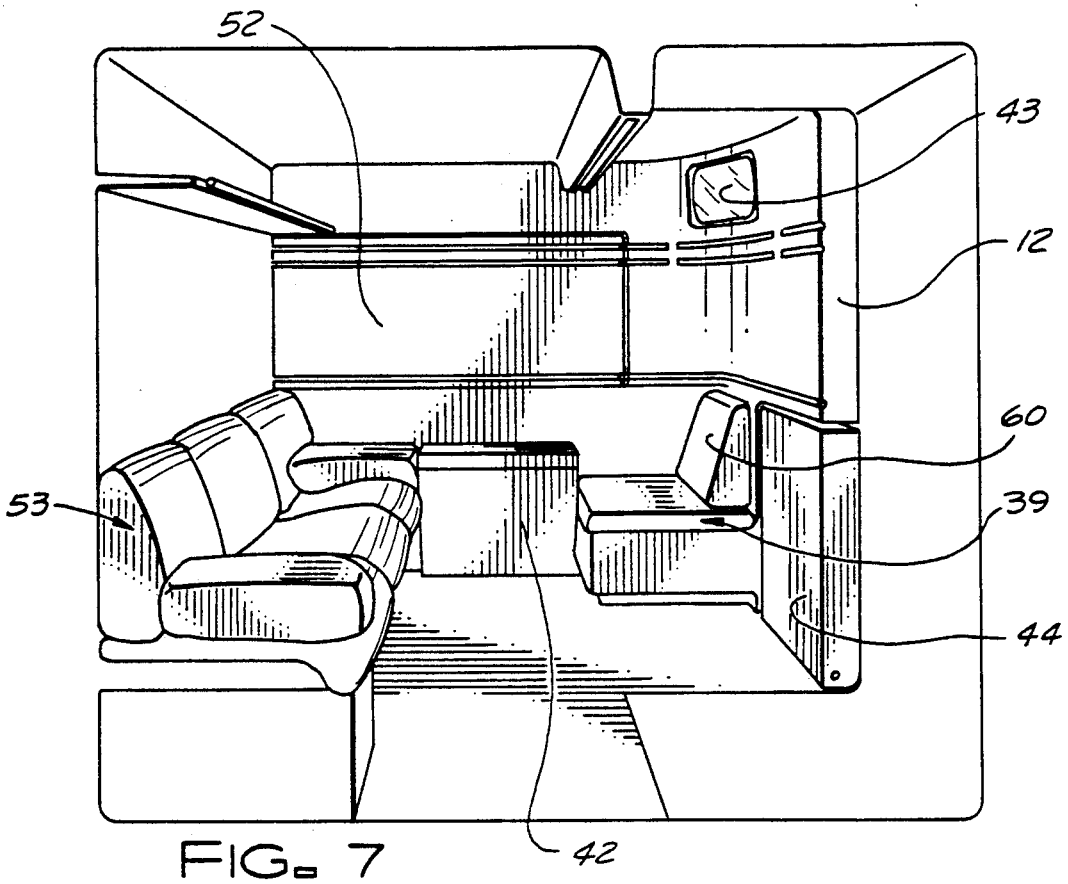
FIG. 7 is a side perspective view of the second embodiment shown in FIG. 7.

Turning now to the drawings in which like reference characters indicate corresponding elements throughout the several views, attention is first directed to FIG. 1 which illustrates a modular unit generally designated by the reference character 10 having a module housing 12 entered by a door 13. Door 13 is secured by a locking system 14 which is preferably a self-contained electronic numeric key pad with programmable changeable unique multi-digit codes. Ideally, a customer will approach the module unit 10 and use a telephone 17 adjacent to door 13. A service representative will greet the customer and ask for the unit number where the customer is located. The service representative will enter the modular unit number into the central computer which will display the status of the module. If the module where the customer is located is unavailable the central computer will display the numbers of the nearby available units, and the representative will give directions to the closest available unit. The service representative may then ask for the name, home telephone number and address of the customer and any other guest accompanying the customer. The service representative will then verify the information and if accurate, obtain and verify the customers credit card information. The service representative will give the customer a three digit number to enter into locking system 14 in order to open module door 13. When the customer checks out and the modular unit 10 has been cleaned and serviced, the housekeeper will be instructed to reset locking system 14 with a new set of three digits received from the computer. Still referring to FIG. 1, module housing 12 contains a window 15 which is in the preferred embodiment, double-glazed in order that passersby may not look in. Each modular unit 10 has a service access 16 which allows entry by housekeeping into a utility space 20. As illustrated in FIG. 1, a service unit enters through service access 16 and will be discussed in greater detail below. A sloping room threshold 20 allows convenient access for wheelchairs or other wheeled apparatus entering modular unit 10. A service unit threshold 22 located by service access 16, allows service unit 18 to be easily installed in utility space 19.

FIG. 2 illustrates module housing 12 of modular unit 10. Positions of the sloped room threshold 20 and service unit threshold 22 are illustrated along with the location of utility space 19. FIG. 2 also illustrates the construction of a generally cubical modular housing 12 which consists of an inner shell 23 and an outer shell 24 defining an interior space 28. In the preferred embodiment there will be at least a four inch space 25 between inner shell 23 and outer shell 24. Space 25 will be filled with structural fire resistant, sound absorbent foam. In addition, space 25 will be used for routing all of the electrical, plumbing, television, telephone and other services throughout modular unit 10. Interior walls 27 are formed in inner shell 23, separating utility space 19 from interior space 28. Floor 26 and interior walls 27 will be constructed of a sandwich composed of fiber glass reinforced plastic, structural honeycomb an foam. Inner shell 23 and outer shell 24 are also preferably constructed of a fiber glass reinforced plastic, which provides an extremely strong rigid, fire resistant shell with good wear resistant properties. Modular unit 10 is substantially self contained, requiring only connection to an electrical outlet and hook-ups for any television or telephone lines that may be desired. The dimensions of modular unit 10 are generally seven and a half feed by nine and a half feet and are seven feet ten inches high. However, these dimensions may vary depending on location of modular unit 10. Generally, modular unit 10 will be constructed in a single molded piece, but do to limited accessibility in some locations, modular unit 10 may be sliced vertically through the center and horizontally at six feed five inches of height to permit easy installation when limited accessibility is provided. Modular housing 12 will remain substantially similar throughout the preferred embodiments described below. The following embodiments will contain varying internal elements in different configurations.

Referring now to FIG. 3, a first embodiment of a modular interior generally designated by the reference character 30 is illustrated enclosed by module housing 12 which was discussed above. Module interior 30 has a settee 32 extending along inner shell 23 adjacent to door 13. Settee 32 is convertible into a lower berth 35 which extends outward from inner shell 23 to dotted line 37.

Referring to FIG. 4, lower berth 35 is illustrated. Settee 32 has a backrest 33 which pivots down around pivot point 34, exposing bedding and pillows for lower berth 35. In its upright position, backrest 33 conceals lower berth 35 and allows the use of settee 32. Also illustrated in FIG. 4 is an upper berth 38. Upper berth 38 is stored flush against inner shell 23 when not in use. When a second berth in needed upper berth 38 pivots on pivot point 36 exposing bedding. As can be seen in FIG. 4, there is an unused space below settee 32 which can be used to store luggage or other material. Referring back to FIG. 3, a seat 39 concealing a toilet 40 is located in the corner of inner shell 23 opposite settee 32 and door 13. Seat 39 and toilet 40 will be discussed in greater detail below. A television set is secured to inner shell 23 above seat 39 and can be easily observed from settee 32. A desk 42 is located on inner shell 23 opposite door 13 between settee 32 and seat 39. Desk 42 is hingedly coupled to inner shell 23 and may be lowered for use or raised flush against shell 23 to increase space in modular unit 10. A shower unit 44 is located between seat 39 and interior walls 27 of utility space 19. In this figure, shower unit 44 is lowered into operating position. Shower 44 will be discussed in more detail below. A lavatory 45 is located on interior walls 27 between door 13 and utility space 19.

Referring now to FIG. 5, first embodiment of modular interior 30 is again illustrated, however, in this view shower unit 44 is in its raised position allowing access to seat 39. In this embodiment, upper berth 38 contains an integral fold down ladder 46 which may be concealed beneath the base of upper berth 38. Ladder 46 will give customers easy access to upper berth 38. In first embodiment 30, a partitioning means using panels sliding 48 as illustrated in FIGS. 3 and 5 can be used to completely separate the lavatory area from the rest of interior space 28 when they are not enclosing the shower-toilet area. In FIG. 3, panels 48 are concealing shower unit 44. In FIG. 5, panels 48 are concealing lavatory 45. Sliding panels 48 will be discussed in more detail when shower unit 44 is discussed below.

Turning now to FIG. 6, a second embodiment of modular interior generally designated by the reference character 50 is illustrated. Second embodiment 50 is contained in modular housing 12 which is identical to that initially discussed and identical to modular housing 12 used in first embodiment 30. Second embodiment 50 is substantially identical to first embodiment 30 with a few changes, specifically, changes in the sleeping arrangement. In this embodiment, a fold down bed 52 is located on inner shell 23 opposite door 13. In this embodiment, a couch 53 is located in the same place as settee 32 of first embodiment 30. However, in second embodiment 50, couch 53 does not convert into a berth. As can be seen in FIG. 7 all other features of embodiment 50 are identical to the features in first embodiment 30.

Figure 8:
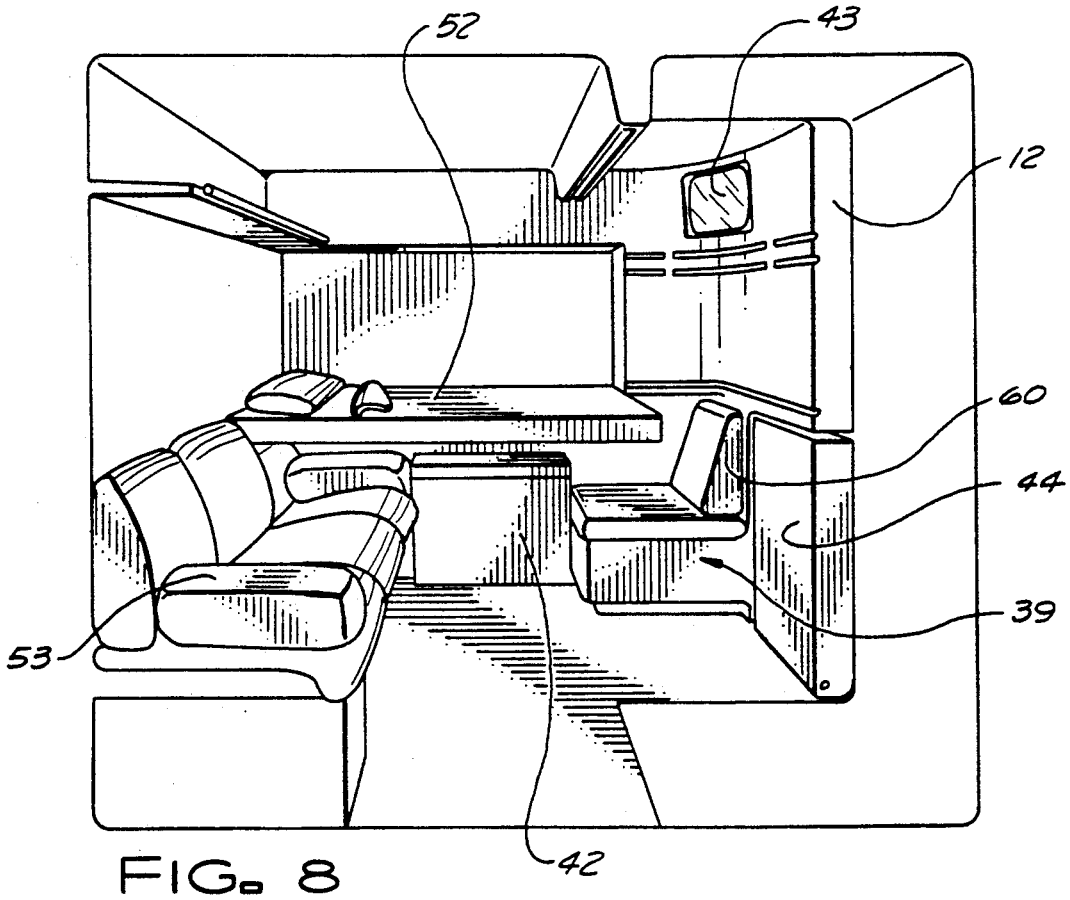
FIG. 8 is a side perspective view of the second embodiment of the present invention similar to that shown in FIG. 8 with sleeping arrangements in the lowered position.
Figure 9:
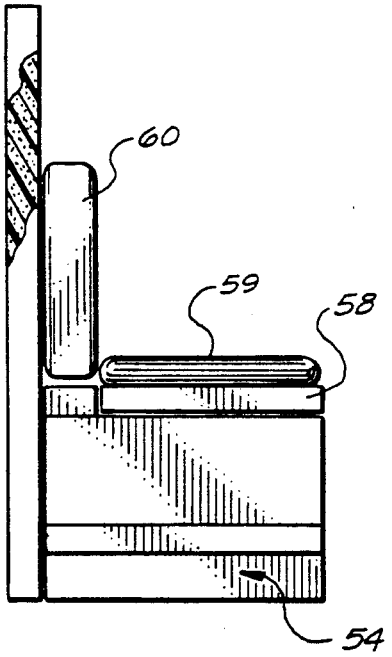
FIG. 9 is a side view illustrating the seat assembly concealing the space saving toilet used in the present invention.

Referring to FIGS. 7 and 8, FIG. 7 illustrates second embodiment 50 with bed 52 in the raised position, recessed into inner shell 23. FIG. 9 illustrates 50 with bed 52 in the lowered position with bedding exposed. Unlike the upper berth 38 in first embodiment 30, berth 52 in second embodiment 50 does not require a ladder to gain access.

Figure 11:
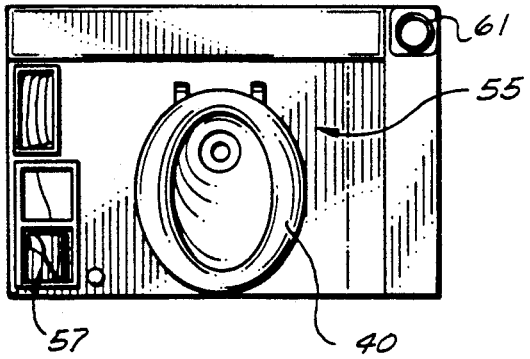
FIG. 11 is a cross-sectional top view of the toilet seat assembly.
Figure 10:
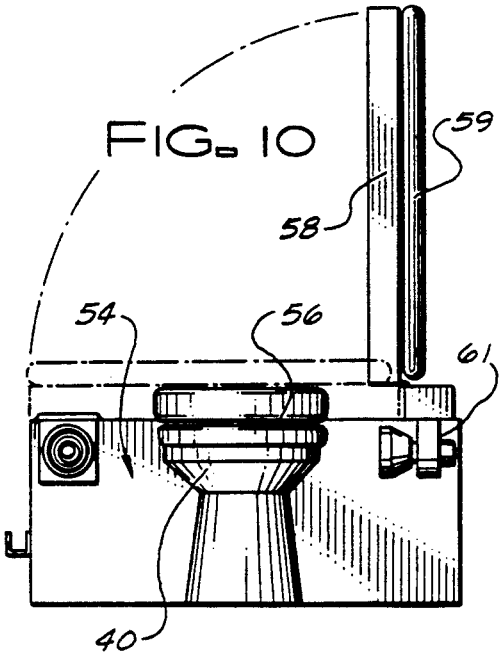
FIG. 10 is a cross-sectional front view of the toilet seat assembly.
Figure 12:
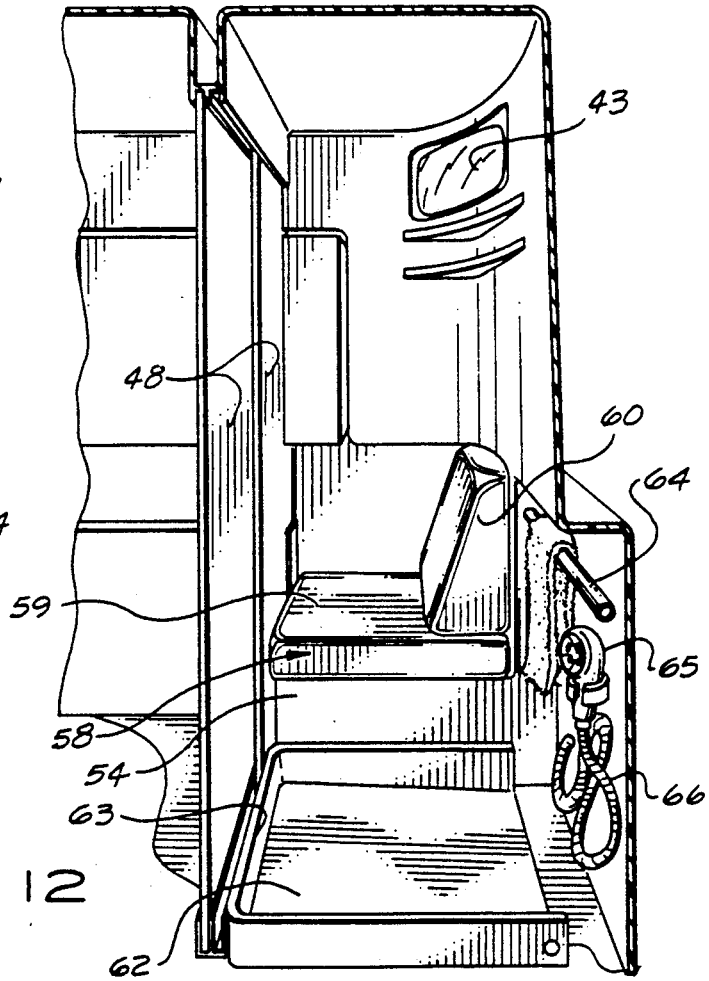
FIG. 12 is a side perspective view similar to that of FIG. 13 showing seat assembly in a closed position and the shower in its extended and operating position.

Referring now to FIGS. 9, 10 and 11, seat 39 and toilet 40 are illustrated. Seat 39 and toilet 40 are used in both first embodiment 30 and second embodiment 50. Referring specifically to FIG. 9, seat 39 consists of a box structure 54 having a top surface 55 with toilet opening 56 and dispenser openings 57. Top surface 55 is covered by a hinged lid 58. Hinged lid 58 has a cushioned top surface 59 which when down, acts as a seat. A backrest 60 is fastened to inner shell 23, and forms the back of seat 39. Hinged lid 58 is hinged to the side of box structure 54 perpendicular to backrest 60. Therefore, hinged lid 58 lifts to the side without having to remove backrest 60, as illustrated in FIG. 10. Toilet 40 fits centrally in box structure 54 and extends into toilet opening 56. A toilet vent fan 61 is coupled next to toilet 40 inside box structure 54. Dispenser openings 57 may be used for a variety of articles. In this embodiment, as illustrated in FIG. 11, toilet paper and sanitary napkins are supplied Referring now to FIG. 12, a portion of the interior of second embodiment 50 is illustrated. The bathroom portion of second embodiment 50 is shown containing seat 39 concealing toilet 40. Shower unit 44 is illustrated in its operating position. In this position a shower pan 62 pivots down from a recessed area of inner shell 23. Shower pan 62 preferably has a nonskid interior surface. The sliding panel partitions 48, mentioned when discussing first embodiment 30, slide through a lip 63 on the outer side of shower pan 62. Lip 63 permits water that runs down sliding panel partitions 48 to be captured in shower pan 62. Shower pan 62 when in the down position, creates a water seal between itself and both seat 39 and interior wall 27 which encloses utility space 19. Shower items such as towel rack 64 and hand held shower head 65 on long flexible hose 66 are all recessed behind shower pan in inner shell 23. All shower items are concealed when shower pan 62 is in its up position. Referring back to seat 39, hinged lid 58 is angled so that it slopes slightly towards shower pan 62. Cushion top 59 is of a hydrophobic material which allows the water from shower unit 44 to sheet down its slope back into shower pan 62.

Figure 13:
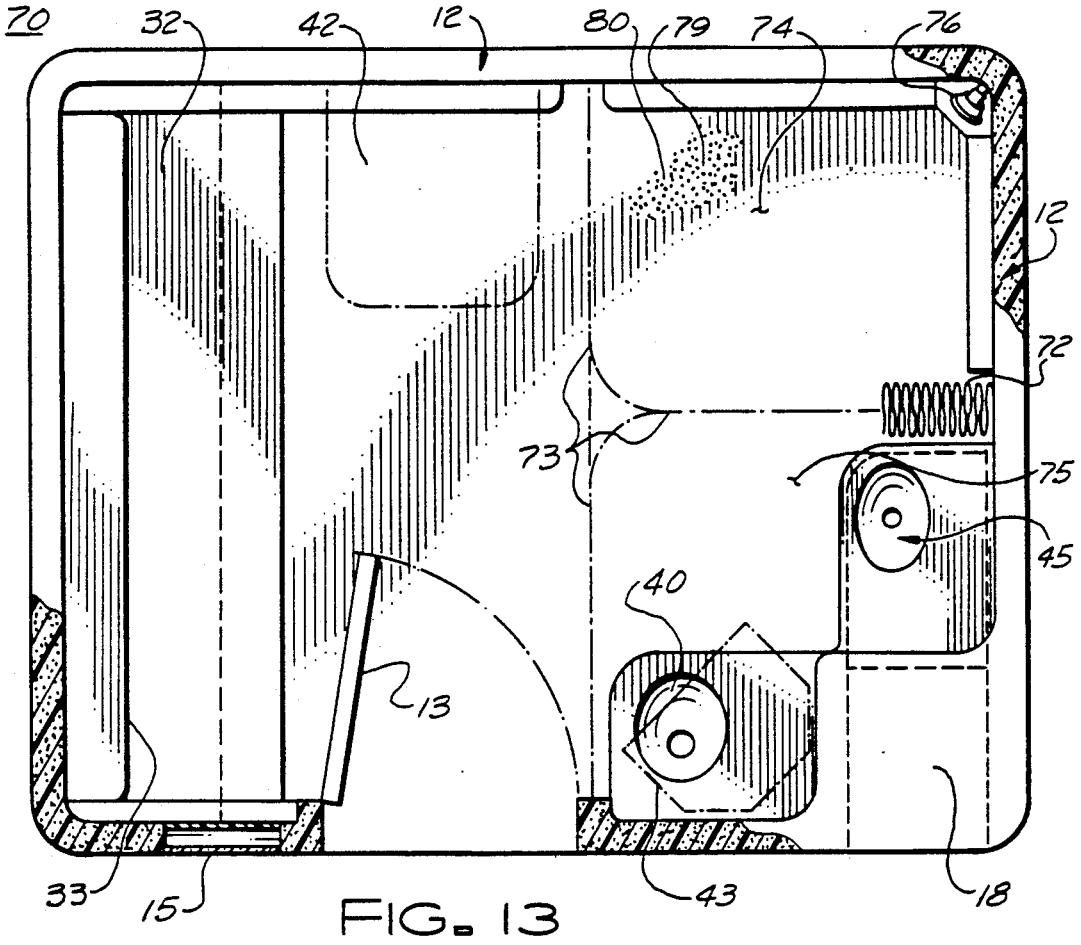
FIG. 13 is a top view of the third embodiment of the modular interior of the present invention.

FIG. 13 is a third embodiment of a modular interior generally designated by the reference character 70 and utilizes the same modular housing 12 as the other embodiments. Third embodiment 70 has a partitioning means using an accordion divider 72. A series of hidden tracks 73 are installed in the ceiling of modular housing 12 which allow partitioning of a shower portion 74, a toilet and lavatory portion 75 or partitioning off the whole side of third embodiment 70 containing the toilet 40 as discussed earlier, lavatory 45, and shower 76. In this embodiment, shower 76 extends from interior shell 23 with no drain or drain pan visible. The floor in shower portion 74 has a series of perforations 80 which lead to a shower pan 78 in the floor of modular housing 12. A carpet 79 which covers the entire floor of third embodiment 70 is a special carpet designed to permit water to pass through to the floor beneath. In this embodiment the floor is also the return air duct for the air conditioning system. This means that all air returning to the air conditioner for dehumidification and temperature adjustment passes through the carpet and floor, back to the air conditioner thus accelerating the drying.

Figure 14:
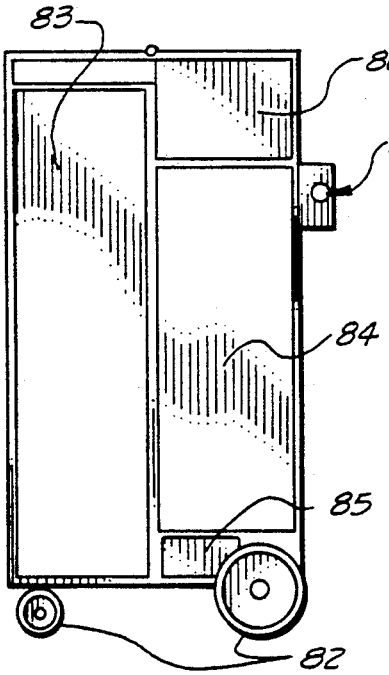
FIG. 14 is a cut away side view of the service unit supplying water and collecting waste from the modular unit.
Figure 15:
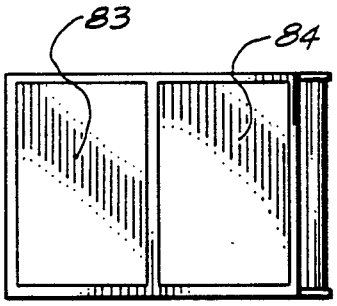
FIG. 15 is a top view of the service unit illustrated in FIG. 14.
Figure 16:
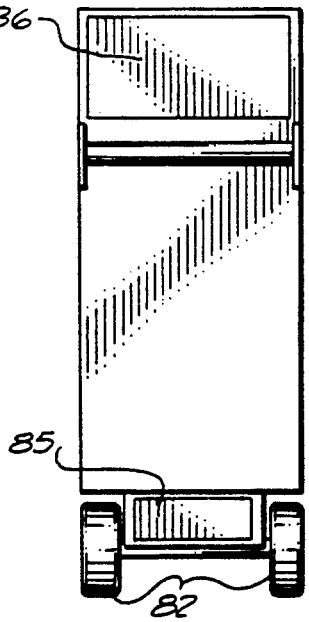
FIG. 16 is a cross-sectional rear view of the service unit illustrated in FIG. 15.

Referring now to FIGS. 14, 15 and 16, service unit 18 is illustrated. Service unit 18 is generally a cart having 4 wheels 82 which allow it to be moved into and out of service utility space 19. Service unit 18 contains a waste water tank 83 which in this embodiment holds approximately forty gallons, a water tank 84 which holds approximately thirty gallons, and a battery compartment 85 located under water tank 84. Above water tank 84 are located hose connections, electrical connections, and a waste discharge pump 113. Since service unit 18 will be very heavy when full, a handle 87 with a hand brake is used to assist moving service unit 18. As illustrated in FIG. 15, service unit 18 is composed largely of waste water tank 83 and water tank 84 and is generally rectangular in shape.

Figure 17:
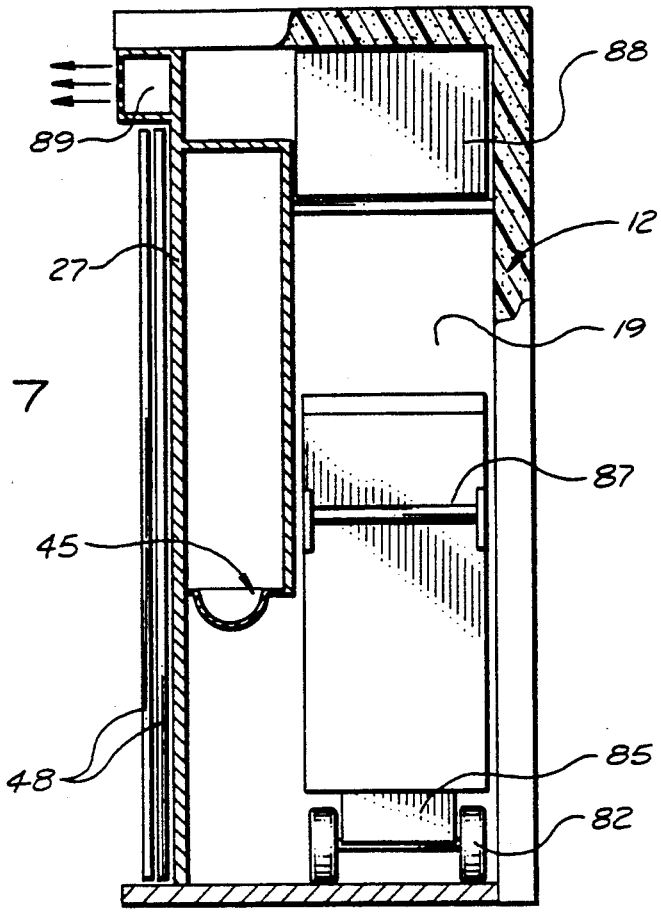
FIG. 17 is a cut away side view of the service portion of the modular unit showing the position of the installed service unit.

Referring now to FIG. 17 which illustrates utility space 19, service unit 18 fits with room above for making connections. At the top portion of utility space 19, against inner shell 23, is an air conditioner unit 88 which provides air flow for modular unit 10. An air duct 89 located above lavatory 45 gives air flow access into interior spaces 28.

Figure 18:
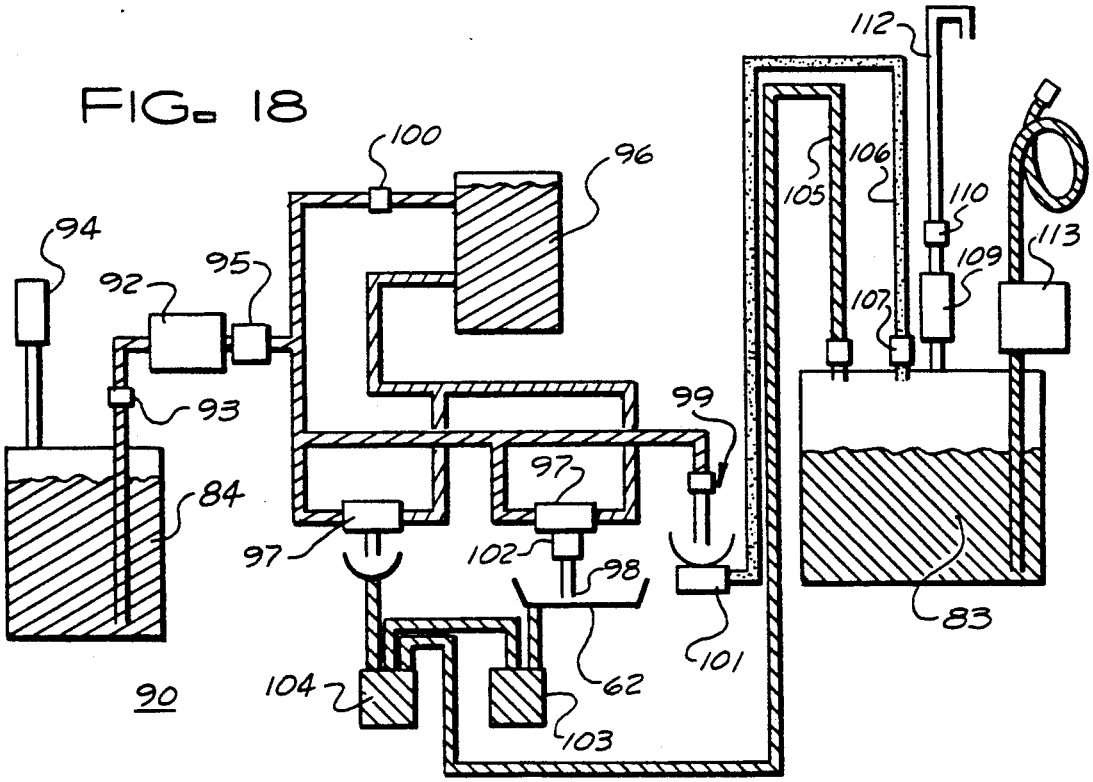
FIG. 18 is a block diagram illustrating the fluid system of the present invention.

FIG. 18 illustrates a fluid system generally designated by the reference character 90. A water tank 84 located in service unit 18 is coupled to a pressure water pump 92 by a quick disconnect fitting 93. Air is inlet into water tank 84 as water is pumped out, through an activated charcoal vent filter 94. A solenoid operated water shut off valve 95 is coupled to the outlet of pressure water pump 92 to enable water flow only when all hoses are connected to service unit 18. Water is also supplied from pressure water pump 92 to a water heater 96 which is preferably six gallons in size and an instant hot water heater. Water is also supplied from pressure water pump 92 to temperature limiting faucets 97, shower head 98, and vacuum toilet 99. Hot water is supplied from hot water heater 96 to each of faucets 97 and shower head 98. A non return valve 100 prevents heated water from mixing with cool water from water tank 84. A solenoid operated valve 102 prevents water from exiting shower head 98 unless shower pan 62 is in the lowered position and sliding partition panels 48 are fully extended. A shower pan pump 103 pumps shower water from shower pan 62 to a lavatory pump 104. Lavatory pump 104 pumps water from shower pan pump 103 and lavatory 45 into waste tank 83 on service unit 18. A quick disconnect coupling 105 connects the tube from lavatory pump 104 to waste tank 83. A pipe 106 from vacuum toilet 99 connects to waste tank 83 by a quick disconnect coupling 107. A charcoal vent filter 109 is attached to waste tank 83 and couples to a waste tank vent hose which extends through the roof of the modular unit IC via a quick disconnect coupling 110. A waste discharge pump 113 is located on service unit 18 and is used to pump waste from waste tank 83 to a waste disposal area when the service unit 18 is being replenished.

Figure 19:
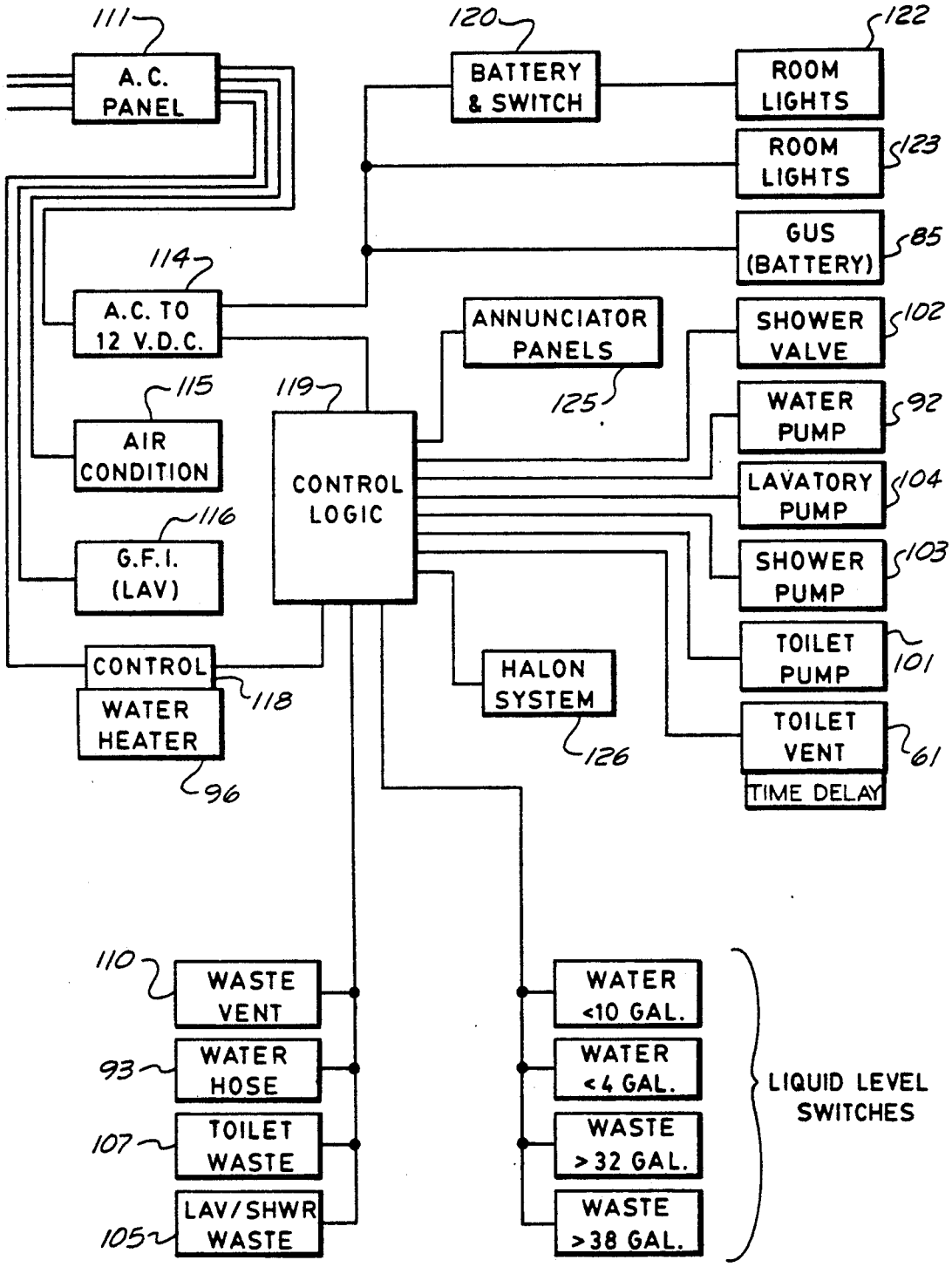
FIG. 19 is a block diagram of the electrical system of the present invention.

FIG. 19 is a block diagram illustrating the electrical system of modular unit 10. Modular unit !0 is connected to an AC panel 111 which supplies electrical current to an AC to 12 volt DC converter 114, an air conditioner 115, a ground fault interrupt 116, and a controller 118 which controls water heater 96. AC to 12 volt DC converter 114 is coupled to control logic means 119 supplying 12 volt DC. A battery and switch 120 is supplied by AC to 12 volt DC 114 and in turn supplies power for emergency room lights 122. Emergency room lights 122 will be operable if no power enters modular unit 10. Room lights 123 are supplied by AC to 12 volt DC 114 as is the battery 85 of service unit 18. All electric appliances in modular unit 10 use 12 V.D.C. Control logic means 119 prevents water from entering fluid system 90 from water tank 84 by closing solenoid operated water shut off valve 95 unless waste vent 110, water hose 93, toilet waste disconnect 107 and sink-shower waste water disconnect 105 are coupled and properly connected to the service unit 18. An annunciator panel 125 is also connected to control logic means 119. Annunciator panel 125 has signal lights which light when notification of certain problems are required. The fluid system is active when all hose connections are secure, water is greater than four gallons in volume in water tank 84 and waste level is less than thirty-eight gallons in waste tank 83. A caution light on annunciator panel 125 will light when water falls below ten gallons or waste increases above thirty-two gallons in service unit 18. A warning light will also come on the annunciator panel 125 when water falls below four gallons or waste increases above thirty-eight gallons in service unit 18. When this occurs, housekeeping will be contacted to replace the service unit 18. Control logic means 119 also controls a halon system 126 which is activated if fire suppression is required. Control logic means 119 controls shower solenoid operated shower valve 102 shutting off water flow if shower pan 62 is not in its fully lowered position. Control logic means 119 further controls water pump 92, lavatory pump 104, shower pump 103 and toilet pump 101. Control logic means 119 also activates toilet vent fan 61 when hinged lid 58 is raised, and shuts off toilet vent fan 61 after a timed delay of two minutes, when hinged lid is closed.

Each of the embodiments described could also contain a variety of luxury or convenience items usually found in hotel rooms such as a telephone with credit card as well as bank card readers. A second line and jack for laptop computer connections. A clock radio with alarm features. Remote controls for television and other electrical controls conveniently located. And if found in an airport, direct channels which display the various airlines' schedules. The lavatory area may contain, besides lavatory 45, a paper towel dispenser, a trash receptacle facial tissue dispenser, paper cup dispenser, mirrors, and built in hair dryer. The shower area may also contain safety grab bars and typical shower supplies. Many other items may be included in modular unit 10 to enhance luxury or convenience and will be known by those skilled in the art.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A portable modular unit comprising a modular housing having:
- an outer shell,
- an inner shell,
- electrical conduits, plumbing, television lines and telephone lines routed between said inner shell and said outer shell,
- structural foam filling the space between said inner shell and said outer shell,
- an entry door extending though one side of said modular housing into an interior space defined by said modular housing;
- a utility space defined by inner walls extending from said inner shell, and separating said utility space from said interior space;
- a service door extending through one side of said modular housing into said utility space; and
- a service unit removably coupled to said modular housing and located in said utility space.

2. A modular unit as claimed in claim 1 wherein said entry door is secured by a locking system.

3. A locking system as claimed in claim 2 comprising an electronic numeric key pad with programmable changeable unique multi digit codes.

4. A modular unit as claimed in claim 1 wherein said service unit comprises:
- a water tank;
- a waste tank;
- a waste discharge pump coupled to said waste tank;
- a battery coupled to said waste discharge pump;
- hose connections for coupling said water tank and said waste tank to said modular housing.

5. A device as claimed in claim 4 wherein said service unit further comprises
- a substantially rectangular housing enclosing said battery, water tank, waste tank and connections;
- wheels coupled to the bottom of said housing; and
- a hand brake coupled to said housing

6. A modular unit as claimed in claim 4 further comprising:
- a fluid system;
- an electrical system; and
- control logic means for controlling said electrical system and said fluid system.

7. A modular unit as claimed in claim 6 wherein said fluid system comprises:
- a pressure water pump coupled to said water tank of said service unit;
- said pressure water pump coupled to a water heater, lavatory, a shower and a vacuum toilet;
- a solenoid operated water shut-off valve regulating water flow from said pressure water pump which is closed by said control logic means when said service unit is improperly connected to said module unit;
- said water heater coupled to said lavatory and said shower;
- a solenoid operated valve regulating water through said shower, controlled by said control logic means;
- a lavatory pump coupling said lavatory to said waste tank;

a shower pump coupling said shower to said waste tank; and a toilet pump coupling said toilet to said waste tank.

8. A device as claimed in claim 7 wherein said water tank is coupled to said pressure water pump by a quick disconnect coupling.

9. A device as claimed in claim 7 wherein said lavatory pump is coupled to said waste tank by a quick disconnect coupling.

10. A device as claimed in claim 7 wherein said shower pump is coupled to said waste tank by a quick disconnect coupling.

11. A device as claimed in claim 7 wherein said interior space can be partitioned into separate areas by sliding panels.

12. A device as claimed in claim 7 wherein said interior space can be partitioned into separate areas by an accordion divider.

13. A portable modular unit as claimed in claim 7 further comprising:

a settee attached to said inner shell;

an upper berth pivotally joined to said inner wall above said settee; and a desk pivotally attached to said inner shell next to said settee.

14. A portable modular unit as claimed in claim 13 wherein said settee in convertible into a lower berth.

15. A portable modular unit comprising:

a generally cubical modular housing defining an interior space having;

an outer shell, an inner shell, electrical, plumbing, television and telephone services routed between said inner and said outer shells, structural foam filling the space between said inner and said outer shells, a removable service unit coupled to said modular housing having;

a water tank, a waste tank, a waste discharge pump coupled to said waste tank, a battery coupled to said waste discharge pump, hose connections for coupling said water tank and said waste tank to said modular housing, a seat in said interior space, attached to said inner shell;

a toilet concealed by said seat and connected to said service unit;

a shower unit in said interior space, attached to said inner shell and coupled to said service unit, and a lavatory in said interior space, attached to said inner shell and coupled to said service unit.

16. A portable modular unit as claimed in claim 15 wherein said seat further comprises:

a box structure having;

a top surface, a toilet opening, and dispenser openings, a hinged lid having a cushioned top which covers said top surface; and a backrest coupled to said inner shell.

17. A portable modular unit as claimed in claim 15 further comprising logic control means for controlling said couplings form said service unit.

18. A portable modular unit as claimed in claim 15 wherein said shower unit further comprises:

a shower pan hingedly coupled to said inner shell; and a shower head coupled to said inner shell by a flexible tube.

19. A shower unit as claimed in claim 18 wherein said shower pan is sloped towards a drain which is coupled to said service unit.

* * * * *

UNITED STATES PATENT AND TRADEMARK OFFICE

CERTIFICATE OF CORRECTION

PATENT NO. : 5,111,626

DATED : May 12, 1992

INVENTOR(S) : Jeffrey L. Fortune

It is certified that error appears in the above-identified patent and that said Letters Patent is hereby corrected as shown below:

Column 8, claim 1, line 16, delete "though" and insert --through--.

Signed and Sealed this

Fifth Day of July, 1994

*Attest:*

*Attesting Officer*

BRUCE LEHMAN

*Commissioner of Patents and Trademarks*